US007647665B2

(12) United States Patent
Disbrow

(10) Patent No.: US 7,647,665 B2
(45) Date of Patent: Jan. 19, 2010

(54) APPARATUS AND METHOD FOR CLEANING CONTROL ROD DRIVE MECHANISM

(75) Inventor: Daniel C. Disbrow, Orlando, FL (US)

(73) Assignee: General Electric Company, Schenectady, NY (US)

( * ) Notice: Subject to any disclaimer, the term of this patent is extended or adjusted under 35 U.S.C. 154(b) by 794 days.

(21) Appl. No.: 11/261,490

(22) Filed: Oct. 31, 2005

(65) Prior Publication Data

US 2007/0094820 A1 May 3, 2007

(51) Int. Cl.
*B08B 9/023* (2006.01)

(52) U.S. Cl. ..... 15/88; 15/88.3; 15/104.04

(58) Field of Classification Search ..... 15/88, 15/88.2, 88.3, 104.04
See application file for complete search history.

(56) References Cited

U.S. PATENT DOCUMENTS 3,903,561 A * 9/1975 McCaslin ..... 15/88
4,503,577 A * 3/1985 Fowler ..... 15/88
4,734,950 A * 4/1988 Schenke et al. ..... 15/88
4,913,177 A * 4/1990 Rieben et al. ..... 134/9
5,172,450 A * 12/1992 Cole et al. ..... 15/302
5,316,588 A * 5/1994 Dyla ..... 134/9
5,613,286 A * 3/1997 McCabe ..... 29/81.04
5,901,400 A * 5/1999 Fulop ..... 15/88
6,990,707 B1 * 1/2006 Heumann et al. ..... 15/302

* cited by examiner

*Primary Examiner*—Randall Chin
(74) *Attorney, Agent, or Firm*—Harness, Dickey & Pierce, PLC

(57) ABSTRACT

An apparatus for cleaning a control rod drive mechanism in a nuclear reactor is disclosed. The apparatus may include an inlet opening for inserting the control rod drive mechanism, an outlet opening, a first support ring engaged with a drive mechanism, a second support ring, and a plurality of brushes positioned between the first and second support rings.

17 Claims, 4 Drawing Sheets

APPARATUS AND METHOD FOR CLEANING CONTROL ROD DRIVE MECHANISM

BACKGROUND OF INVENTION

1. Field of the Invention

This invention relates generally to a tool for cleaning the internal surfaces of a control rod drive mechanism which may be used in a nuclear reactor vessel.

2. Description of Related Art

A reactor pressure vessel (RPV) of a boiling water reactor (BWR) typically has a generally cylindrical shape and is closed at both ends, e.g., by a bottom head and a removable top head.

At various times during the operational life of a nuclear reactor, there is a need to remove the core and internals from the reactor vessel for maintenance. For example, graphite seals in the control rod drive mechanism (CRDM) wear out gradually, and corrosion products build up inside the drive, which must be cleaned to reduce contamination levels and maintain performance. If regular maintenance of the CRDM is not performed, excessive seal leakage may lead to operational difficulties or inoperative CRDMs.

CRDMs reside in the bottom of the core, and are a natural collection point for any crud or debris that is released from the core. The process of scramming the CRDM generates mechanical, thermal and hydraulic shocks in the vessel, while simultaneously direct high volumes of water through the CRDM to create the desired control rod insertion. This can result in very high levels of contamination and radiation on the surfaces of the CRDM.

Accordingly, a need exists for cleaning the control rod drive mechanism to minimize dose and contamination to the workers performing the CRDM maintenance, as well any other personnel who may be in the area where the drive is stored, handled or installed.

SUMMARY OF THE INVENTION

Exemplary embodiments of the present invention are directed to an apparatus for cleaning the debris found on the control rod drive mechanism and for cleaning the surface.

An exemplary embodiment of the present invention provides an apparatus for cleaning a control rod drive mechanism following removal from a nuclear reactor. The apparatus may include an inlet opening for inserting the control rod drive mechanism, an outlet opening, a first support ring engaged with a drive mechanism, a second support ring operable with the first support ring, and a plurality of brushes positioned between the first and second support rings.

Another exemplary embodiment of the present invention provides a system for cleaning a control rod drive mechanism internals as they are removed from the assembly. The system may include a drive assembly for driving gears, a gear reduction assembly for reducing the speed of the motor, and a cleaning assembly for cleaning the control rod drive mechanism.

BRIEF DESCRIPTION OF THE DRAWINGS

Exemplary embodiments of the present invention will become more apparent by describing, in detail, exemplary embodiments thereof with reference to the attached drawings, wherein like procedures are represented by like reference numerals, which are given by way of illustration only and thus do not limit the present invention.

DETAILED DESCRIPTION OF EXEMPLARY EMBODIMENTS

It should be noted that these Figures are intended to illustrate the general characteristics of method and apparatus of exemplary embodiments of the present invention, for the purpose of the description of such exemplary embodiments herein. These drawings are not, however, to scale and may not precisely reflect the characteristics of any given embodiment, and should not be interpreted as defining or limiting the range of values or properties of exemplary embodiments within the scope of this invention. Like numerals are used for liked and corresponding parts of the various drawings.

Figure 1:
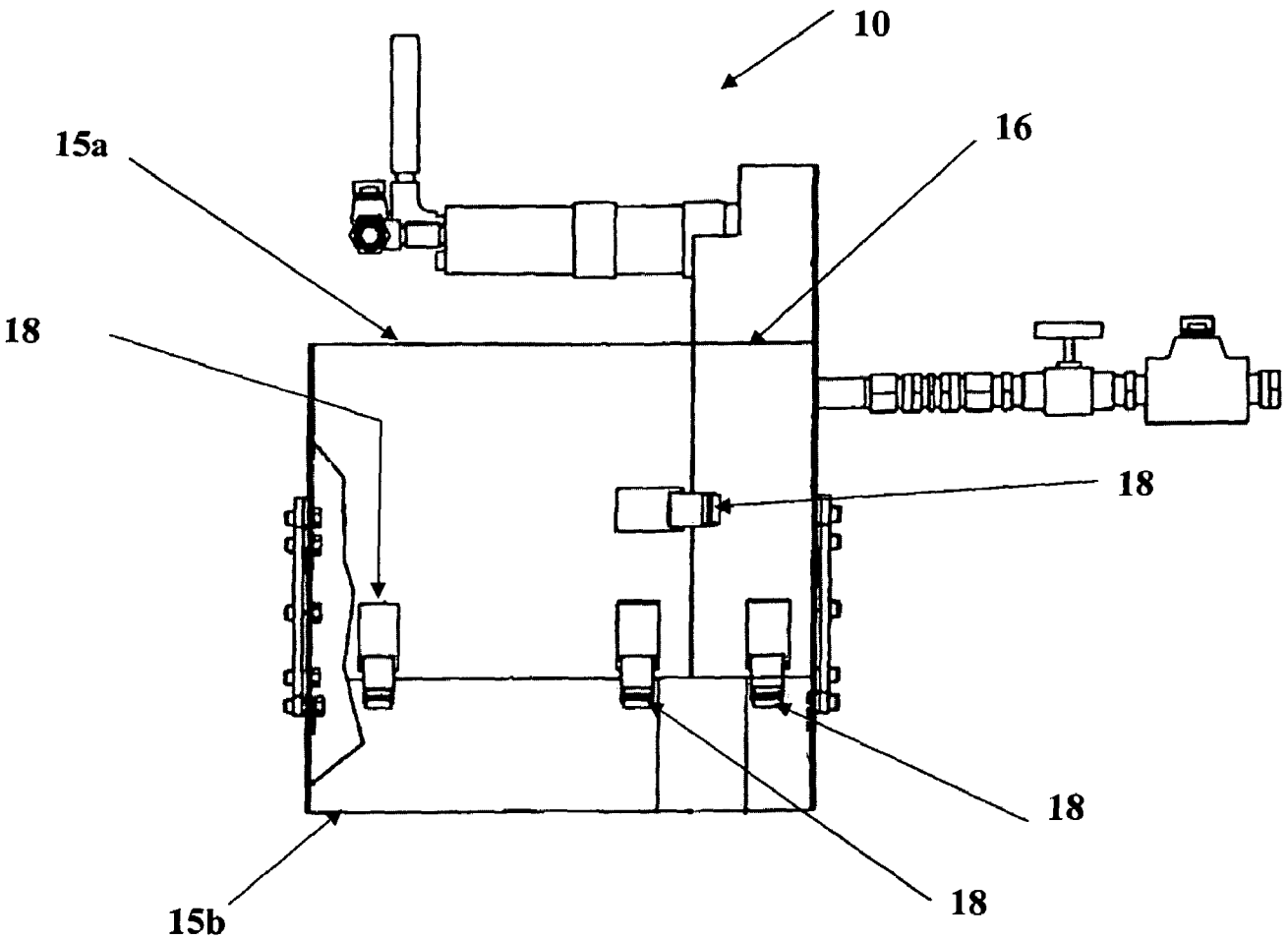
FIG. 1 is a side view of an apparatus for cleaning control rod drive mechanism in accordance with an exemplary embodiment of the present invention.
Figure 2B:
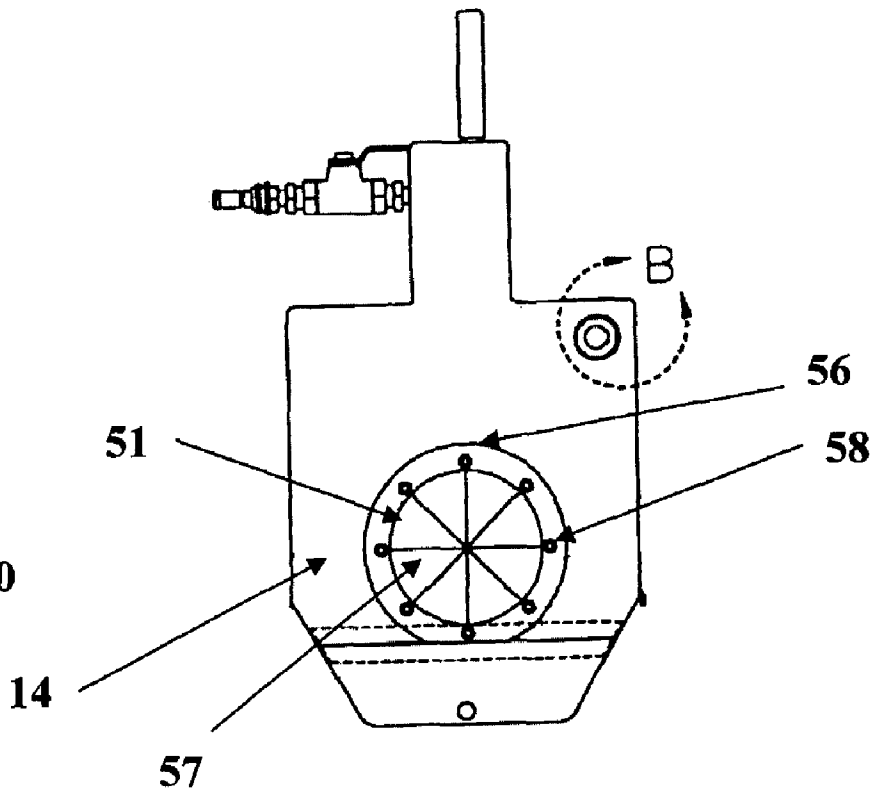
FIG. 2B is a back view of an apparatus for cleaning control rod drive mechanism in accordance with an exemplary embodiment of the present invention.
Figure 2A:
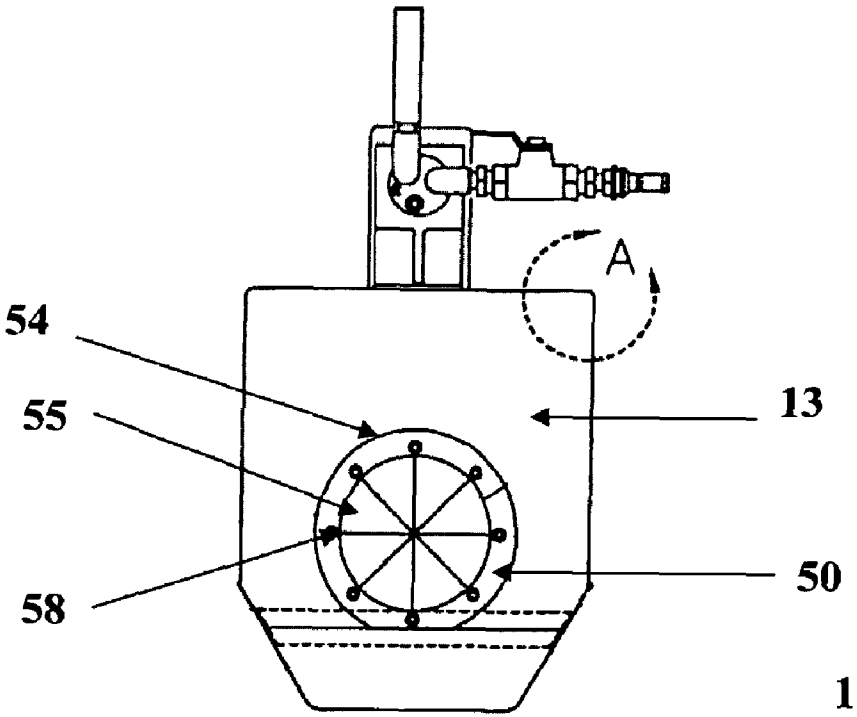
FIG. 2A is a front view of an apparatus for cleaning control rod drive mechanism in accordance with an exemplary embodiment of the present invention.

FIGS. 1 and 2A-2B are views of an apparatus for cleaning control rod drive mechanism in accordance with an exemplary embodiment of the present invention. In particular, FIG. 1 is a side view of the apparatus; FIG. 2A is a front view of the apparatus; and FIG. 2B is a back view of the apparatus.

Referring to FIG. 1, the apparatus 10 includes a top casing 15*a*, a bottom casing 15*b*, and a back cover 16 for enclosing the internal parts of the apparatus 10. The casings 15*a*, 15*b* and back cover 16 are made from stainless steel. However, it should be appreciated that other materials, such as steel or aluminum, for example, may be employed. Each casing 15*a*, 15*b* is locked by a plurality of draw latches 18. As an exemplary embodiment, three latches 18 are horizontally placed to lock casing 15*a* and casing 15*b* together, and one latch 18 is vertically placed to lock casing 15*a* and back cover 16 together. It should be appreciated that the other side of the apparatus 10 may provide the latches at the same location.

Figure 3:
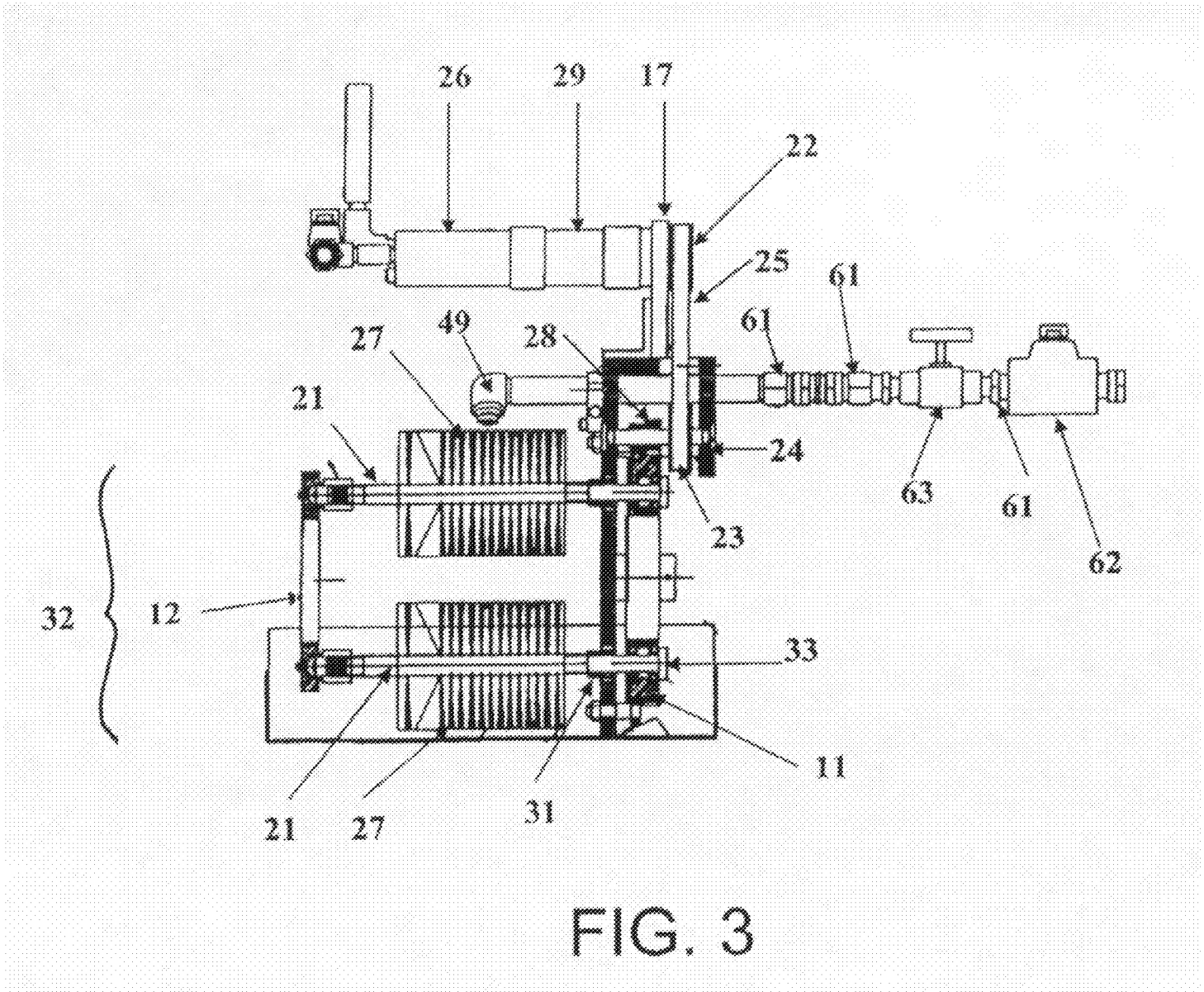
FIG. 3 is a side view of an apparatus exposing the interior parts in accordance with an exemplary embodiment of the present invention.

FIG. 2A is a front view of apparatus 10 for cleaning control rod drive mechanism in accordance with an exemplary embodiment of the present invention. The apparatus 10 includes a front plate 13. The front plate 13 includes an opening 50 for inserting the control rod drive internals to be cleaned. The opening 50 is surrounded by a ring member 54. The ring member 54 serves the purpose of attaching a rubber flap 55 to cover the opening 50, and aligning the control rod drive internals with a brush support ring 12 (as shown in FIG. 3). The rubber flap 55 may be cut into multiple sections (e.g., 7 sections). The ring member 54 is attached to the front plate 13 along with the rubber flap 55 with a plurality of fasteners 58, for example, a screw and nut combination. The screw 58 may be ½ inch, 20 UNC, for example. The rubber flap 55 covers the opening 50 and is tightly secured by the ring member 54.

FIG. 2B is a back view of apparatus 10 for cleaning control rod drive mechanism in accordance with an exemplary embodiment of the present invention. The apparatus 10 includes a back plate 14. The back plate 14 includes an opening 51 for exiting the control rod drive internals out of the apparatus. The opening 51 aligns with opening 50 in the front plate 13. The opening 51 is surrounded by a ring member 56. A rubber flap 57 is provided to cover the opening 51. The rubber flap 57 may be cut into multiple sections (e.g., 7 sections). The ring member 56 is attached to the back plate 14 along with the rubber flap 57 with a plurality of fasteners 58, for example, a screw and nut combination.

FIG. 3 is a schematic view of exposed internal parts of the apparatus 10 (without casings 15*a*, 15*b*) in accordance with an exemplary embodiment of the present invention. FIG. 4A is a front view of the apparatus 10 without the top casing 15*a*; and FIG. 4B is a back view of the apparatus 10 without the top casing 15*a*.

Referring to FIG. 3, the apparatus 10 includes a drive assembly for driving the gears, a gear reduction assembly for reducing the speed of the motor, and a cleaning assembly for cleaning the control rod drives.

The drive assembly includes a motor 26 mounted on a motor mount 17. A muffler 29 may also be mounted on the motor mount 17 for reducing noise. The motor 26 may be a permanent magnet d.c. motor. However, it should be appreciated that other types of motors may be provided as long as the motor produces the appropriate speed and power. The characteristics of the particular type of motor that is selected will be determined based on a reduction ratio that is provided by the reduction gear assembly 28.

Figure 4B:
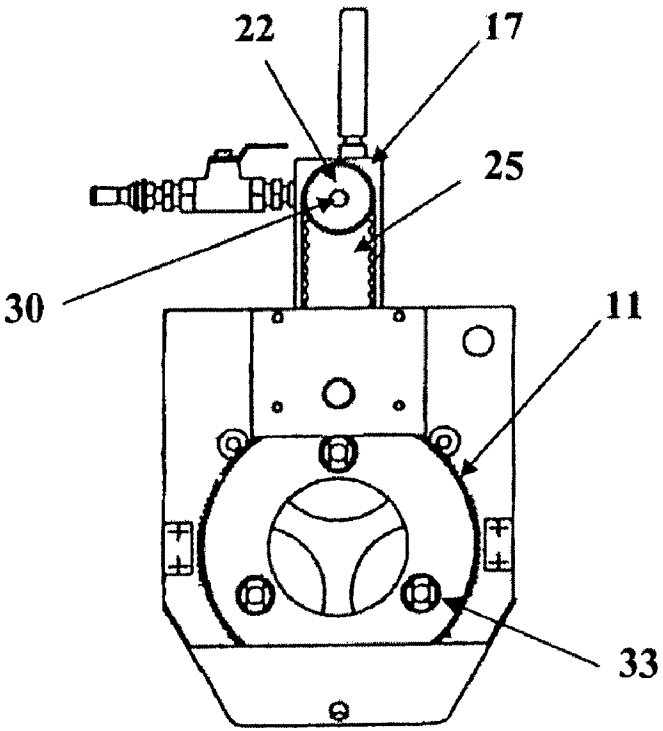
FIG. 4B is a back view of an apparatus for cleaning control rod drive mechanism without a cover in accordance with an exemplary embodiment of the present invention.
Figure 4A:
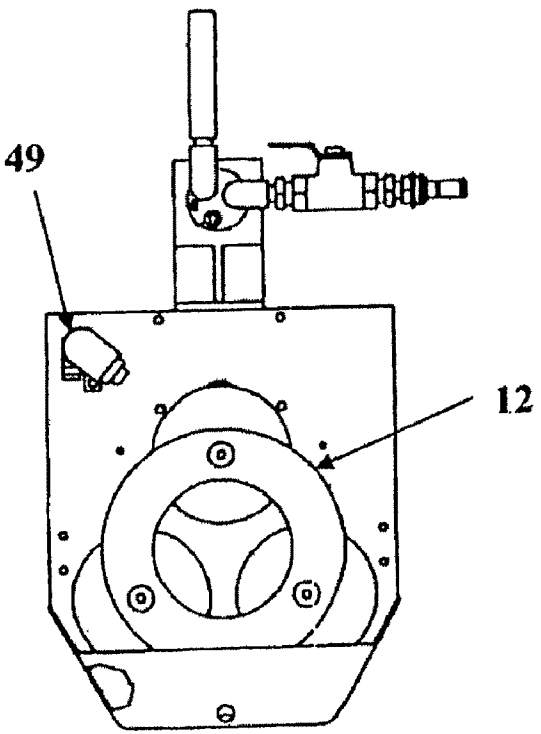
FIG. 4A is a front view of an apparatus for cleaning control rod drive mechanism without a cover in accordance with an exemplary embodiment of the present invention.

Referring to FIG. 4B, the drive arrangement includes a motor shaft 30 engaged to a pulley 22. The pulley 22 is connected to another pulley 23 (FIG. 3) below pulley 22. A belt drive 25 connects the pulleys 22, 23 to rotate a drive shaft 24. Although a belt drive 25 is shown as an exemplary embodiment, it should be appreciated that a chain, a wire rope or a cable may be used to connect the drive shaft 24 to the motor shaft drive 30.

Referring back to FIG. 3, the drive shaft 24 engages with a reduction gear assembly 28. The reduction gear assembly 28 may be one or more gears for reducing the speed of the motor 26. The drive shaft 24 may be operatively connected to an output pinion of reduction gear assembly by a face gear (not shown). Alternatively, it should be appreciated that other types of gear arrangements may be used. The reduction gear assembly 28 may be any wide variety of gear reduction systems, such as a spur gear reduction system. Alternatively, a worm gear reduction system could also be used.

The reduction gear assembly 28 engages with a cleaning assembly 32 for operation. The cleaning assembly 32 may include a first support ring 11, a second support ring 12, and a plurality of brushes 27. The first support ring 11 includes a plurality of teeth to engage with the reduction gear assembly 28. As the belt drive 25 moves, the reduction gear assembly 28 engages and rotates the first brush support ring 11.

A plurality of brush shafts 21 are connected on the first support ring 11. Each brush shaft 21 includes gears 31 at one end to engage and rotate with the first brush support ring 11. Moreover, each brush shaft 21 includes bushings 33 to rotate within its axis. As an exemplary embodiment, there are three shafts 21 connected on the first support ring 11, positioned 120 degrees apart (as shown in FIGS. 4A and 4B). Each brush shaft 21 is tightly engaged to the support ring 11 by a nut 22, for example. At the other end of each of the brush shaft 21 is a second support ring 12. The second support ring 12 has the same inner diameter and aligned in the same axis as the first support ring 11 so as to move the control rod drive mechanism through the inner diameters of the support rings 11, 12. The second support ring 12 is made from, preferably, but not limited to, a plastic material.

Referring to FIG. 3, the cleaning assembly includes a plurality of brushes 27, preferably, but not limited to, brushes are connected on each brush shaft 21. The brushes 27 include a plurality of bristles for removing contaminates on the control rod. Each brush 27 rotates within its axis via brush shaft 21. As the control rods internals are inserted into the opening in the second support ring 12, the brushes rotate at an appropriate speed to remove any debris from the rods.

When the rod internal is inserted into the opening and being cleaned, fluid, preferably, water is sprayed on the brushes 27 via a water outlet nozzle 49 as shown in FIGS. 3 and 4A. Water is introduced into the apparatus 10 through a series of hose-pipe fittings 61 and valves (e.g., ball 62 and needle valves 63), as shown in FIG. 3.

During operation of the apparatus 10, water is applied to the brushes 27 so as to wet the bristles and to reduce heat accumulation. Then, the user inserts the control rod drive mechanism internals into opening 50 in the front end of apparatus 10 such that the rod internals may enter into the ring support 12. The control rod drive mechanism internals is advanced to the rotating brushes 27 to remove any debris and clean the surface. The control rod drive mechanism internals is advanced until the end of the control rod drive mechanism exits the opening 51 in the back end of the apparatus 10.

The exemplary embodiments of the present invention being thus described, it will be obvious that the same may be varied in many ways. Such variations are not to be regarded as departure from the spirit and scope of the exemplary embodiments of the present invention, and all such modifications as would be obvious to one skilled in the art are intended to be included within the scope of the following claims.

What is claimed:

1. An apparatus for cleaning a control rod drive mechanism in a nuclear reactor, comprising:

a housing including an inlet opening configured to permit insertion of a control rod drive mechanism into the housing and an outlet opening aligned with the inlet opening, the outlet opening configured to permit exiting of the inserted control rod drive mechanism from the housing;

a motorized drive;

a first support ring within the housing, the first support ring engaged with the motorized drive;

a second support ring within the housing; and a plurality of shafts connected between the first support ring and the second support ring, each shaft including a plurality of brushes, the first and second support rings configured to rotate about the inserted control rod drive mechanism so as to rotate the plurality of shafts about the inserted control rod drive mechanism.

2. The apparatus according to claim 1, wherein the first support ring rotates the second support ring through the plurality of shafts.

3. The apparatus according to claim 1, wherein the shafts include at least one gear configured to engage with at least the first support ring.

4. The apparatus according to claim 1, wherein the plurality of shafts is configured to rotate, so as to rotate each brush.

5. The apparatus according to claim 1, wherein the first support ring is a gear engaged with the motorized drive.

6. The apparatus according to claim 5, wherein the gear of the first support ring is a spur gear.

7. The apparatus according to claim 1, wherein the inlet opening is aligned with the second support ring.

8. The apparatus according to claim 7, wherein the ring member is enclosed with a rubber flap.

9. The apparatus according to claim 1, wherein the outlet opening is aligned with the first support ring.

10. The apparatus according to claim 1, wherein the inlet and outlet openings are surrounded by a ring member.

11. The apparatus according to claim 1, wherein the motorized drive includes a drive belt to rotate the first support ring.

12. The apparatus according to claim 1, wherein the plurality of shafts is configured to rotate while water is applied.

13. A system for cleaning a control rod drive mechanism in a nuclear reactor, comprising:

a drive assembly;

a cleaning assembly for cleaning the control rod drive mechanism, the cleaning assembly including, a first support ring engaged with the drive assembly, a second support ring, and a plurality of shafts connected between the first support ring and the second support ring, each shaft including a plurality of brushes, the shafts and the first and second support rings configured to rotate about an inserted control rod drive mechanism when driven by the drive assembly; and a reduction gear assembly coupled between the drive assembly and the cleaning assembly, the reduction gear assembly configured to permit different rotation speeds among the drive assembly and the first support ring engaged with the drive assembly.

14. The system according to claim 13, wherein the drive assembly includes a motor, at least one pulley, a belt, and a drive shaft.

15. The system according to claim 14, wherein the drive shaft engages with the reduction gear assembly.

16. The system according to claim 13, wherein the reduction gear assembly include a plurality of reduction gears, at least one of the reduction gears engaging with the first support ring.

17. The system according to claim 13, wherein the plurality of brushes is configured to clean a surface of an inserted control rod drive mechanism.

* * * * *